US007500281B2

(12) United States Patent
Dingert

(10) Patent No.: US 7,500,281 B2
(45) Date of Patent: Mar. 10, 2009

(54) SELF-WRINGING MOP

(75) Inventor: Uwe Dingert, Absteinach (DE)

(73) Assignee: Carl Freudenberg KG, Weinheim (DE)

( * ) Notice: Subject to any disclaimer, the term of this patent is extended or adjusted under 35 U.S.C. 154(b) by 1196 days.

(21) Appl. No.: 10/371,815

(22) Filed: Feb. 21, 2003

(65) Prior Publication Data

US 2004/0006836 A1 Jan. 15, 2004

(30) Foreign Application Priority Data

Feb. 21, 2002 (DE) ..... 102 07 384

(51) Int. Cl.
*A47L 13/142* (2006.01)

(52) U.S. Cl. ..... 15/120.1; 15/120.2

(58) Field of Classification Search ..... 15/120.1, 15/120.2

See application file for complete search history.

(56) References Cited

U.S. PATENT DOCUMENTS

| | | | | |
|---|---|---|---|---|
| 1,514,051 A | | 11/1924 | Jumonville | |
| 1,520,500 A | * | 12/1924 | Jumonville | 15/120.2 |
| 5,509,163 A | * | 4/1996 | Morad | 15/120.2 |
| 6,115,869 A | | 9/2000 | Libman | 15/120.1 |
| 6,212,727 B1 | | 4/2001 | Bendor | 15/120.1 |
| 6,212,728 B1 | | 4/2001 | Facca et al. | 15/120.2 |
| 2004/0128783 A1 | * | 7/2004 | Lesley et al. | 15/120.1 |

FOREIGN PATENT DOCUMENTS

FR 568977 4/1924

* cited by examiner

*Primary Examiner*—Mark Spisich
(74) *Attorney, Agent, or Firm*—Davidson, Davidson & Kappel, LLC

(57) ABSTRACT

A self-wringing mop includes a handle, an operating sleeve, a mop head, and at least one blocking element. The handle includes a first longitudinal section having a polygonal cross-section with a plurality of edges running in an axial direction. The operating sleeve is twistably disposed on the handle so as to be twistable relative to the handle in a wringing direction and in an opposite direction. The mop head is disposed at a lower end of the handle and includes cleaning elements configured to be wrung out by a twisting in the wringing direction. The at least one blocking element protrudes radially inward from the operating sleeve toward the handle so that a twisting of the sleeve in the wringing direction results in the blocking element moving past the plurality of edges against an elastic force, and a twisting in the opposite direction results in at least one of the plurality of edges pressing the blocking element against the operating sleeve so as to block a further twisting in the opposite direction.

16 Claims, 3 Drawing Sheets

SELF-WRINGING MOP

This application claims priority to German Patent Application DE 102 07 384.8-15, filed Feb. 21, 2002, which is incorporated by reference herein.

BACKGROUND

The present invention relates to a self-wringing mop, having a handle, an operating sleeve twistably mounted on the handle, a mop head including cleaning elements which may be wrung out by a relative twist between the handle and the operating sleeve, and having a backtwist blocking device for fixing the sleeve on the handle against unintentional backtwisting during wringing, including ribbed elevations extending in the axial direction at least on a predefined limited longitudinal section of the handle, and at least one blocking element protruding inwardly from the operating sleeve radially into the twisting area of the ribbed elevations; the blocking element is pressed against the wall of the operating sleeve by the ribbed elevations when the handle is twisted in the blocking direction, thus forming a stop for the ribbed elevations; however, it moves past the ribbed elevations outwardly against an elastic force when the handle is twisted in the unblocked direction.

In a self-wringing mop, having a handle, an operating sleeve that is axially displaceable and twistably mounted on the handle, and a mop head including cleaning elements which may be wrung out by a relative twist between the handle and the operating sleeve, there are numerous approaches to prevent the unintentional backtwisting of the operating sleeve on the handle due to the restoring forces, originating from the expanded cleaning elements, when the handle is released for the next twisting motion. For example, from U.S. Pat. No. 6,115,869 a self-wringing mop is known which is composed of a handle, a sleeve axially displaceable and twistably situated on the handle, and a mop head including string-shaped cleaning elements which, with their lower ends, are attached to the lower end of the handle and with their upper ends to the lower end of the operating sleeve. By displacing the operating sleeve from a lower wiping position in which the cleaning elements are sagging loop-like and where the operating sleeve is freely twistable, they may be brought upward into a wringing position, in which they are stretched and wrung out by twisting of the operating sleeve. In order to prevent backtwisting of the operating sleeve during wringing and during grip change on the handle, the known self-wringing mop has a ratchet device. Situated on the handle, this device is composed of a ring from which spring elements stick out radially. Correspondingly, the operating sleeve has ribs in the upper area of its internal circumference. For wringing, the operating sleeve is pulled upward from the lower wiping position all the way over the ring having the spring elements and is then twisted in the wringing direction. The spring elements and the ribs are designed and placed in such a way that twisting in the wringing direction is possible; however, wringing in the opposite direction is blocked. In order to disengage the blocking device after wringing, the operating sleeve is pushed downward again in a simple manner so that the spring elements and the ribs no longer engage. Disadvantageous in this known device is, above all, the fact that a certain risk of injury exists for the user due to the spring elements radially sticking out. It is furthermore disadvantageous that the rib structure as well as the spring elements must be manufactured in a tightly fitting manner and must be adjusted to one another since the blocking device has a positive fit. This results in a complex manufacturing process, as well as in high manufacturing costs.

A similar approach is provided in U.S. Pat. No. 6,212,728 B1, which describes another self-wringing mop. This mop, like the one described above, has a handle, an operating sleeve, a mop head including string-shaped cleaning elements which are attached both to the handle and the operating sleeve, as well as a backtwist blocking device. The backtwist blocking device is composed of a blocking element which extends radially from the operating sleeve inwardly into the through opening of the operating sleeve and engages in a corresponding rib structure on the handle. During twisting in the wringing direction, the blocking element moves past the ribbed elevations situated on the handle outwardly against an elastic force. During twisting in the opposite direction, the blocking element is supported by the sleeve wall, thus forming a stop for the ribbed elevations on the handle. The twisting motion is blocked. The rib structure is only provided on a limited longitudinal section on the handle so that the blocking device may be disengaged again by pushing down the operating sleeve. The wringing operation corresponds to the one described above. The components of the backtwist blocking device must also be manufactured with a tight fit in this self-wringing mop, as is the case in the mop described above, thus increasing manufacturing costs and manufacturing complexity.

SUMMARY OF THE INVENTION

It is an object of the present invention to refine a cleaning device according to the definition of the species in such a way that the backtwist blocking device becomes manufacturable in a more simple and cost-effective manner and that in particular as few components as possible are needed.

The present invention provides a self-wringing mop (1) comprising a handle (2), an operating sleeve (3) twistably situated on the handle (2), and a mop head (7) including cleaning elements which may be wrung out by a relative twisting between the handle (2) and the operating sleeve (3), and comprising a backtwist blocking device for fixing the operating sleeve (3) on the handle (2) to prevent an unintentional backtwist during the wringing operation. The backtwist blocking device includes ribbed elevations extending in the axial direction on at least one predefined limited longitudinal section (2.1) of the handle (2), and at least one blocking element (8.1) protruding radially inward into the twisting area of the ribbed elevations starting from the operating sleeve (3). The blocking element is pressed against the wall of the operating sleeve (3) by the ribbed elevations during twisting of the handle (2) in the blocking direction, thus forming a stop for the ribbed elevations, while during twisting in the unblocked direction, the blocking element moves past the ribbed elevations outwardly against an elastic force. The handle (2) has a polygonal cross section in the predefined limited longitudinal section (2.1), and the ribbed elevations are formed by the edges (2.1.1, 2.1.2) of this longitudinal section (2.1) extending in the axial direction.

The present invention also provides a backtwist blocking device for a sleeve (3) which is twistably situated on a rod-like element, in particular an operating sleeve (3) situated on a handle of a cleaning device including ribbed elevations which extend in the radial direction across at least one limited longitudinal section of the rod-like element, and at least one blocking element (8.1) which protrudes inward into the twisting area of the ribbed elevations starting at the sleeve (3). The blocking element (8.1) is designed and positioned in such a way that it is pressed against the wall of the sleeve by the ribbed elevations when the rod-like element is twisted in the blocking direction, thus forming a stop for the ribbed elevations, while when the rod-like element is twisted in the unblocked direction, the blocking element moves past the ribbed elevations outwardly against an elastic force. The rod-like element has a polygonal cross section in the predefined limited longitudinal section, and the ribbed elevations are formed by the edges (2.1.1, 2.1.2) of this longitudinal section extending in the axial direction.

In a self-wringing mop according to the present invention, having a handle, an operating sleeve twistably situated on the handle, a mop head including cleaning elements which may be wrung out by a relative twist between the handle and the operating sleeve, and having a backtwist blocking device for fixing the sleeve on the handle against unintentional backtwisting during wringing, including ribbed elevations extending in the axial direction at least on a predefined limited longitudinal section of the handle, and at least one blocking element protruding inwardly from the operating sleeve into the twisting area of the ribbed elevations, the blocking element is pressed against the wall of the operating sleeve by the ribbed elevations when the handle is twisted in the blocking direction, thus forming a stop for the ribbed elevations; however, it moves past the ribbed elevations outwardly against an elastic force when the handle is twisted in the unblocked direction. The handle has a polygonal cross section in the predefined longitudinal section and the ribbed elevations are formed by the edges of this longitudinal section extending in the axial direction.

The blocking element is preferably situated tangentially outwardly displaceable, following the unblocked direction of the circumferential edges of the handle.

The self-wringing mop according to the present invention is characterized by a simple and cost-effective design. Due to the use of a handle having a polygonal cross section at least across a limited longitudinal section, no additional components are needed, in particular no additional rings having a grooved or ribbed structure. Since the blocking element is simply pushed outward by the edges of the twisting handle, no complicated shaping is necessary. In particular, no positive fit is necessary. Also, the self-wringing mop according to the present invention has no sharp-edged components which stick out, representing an injury risk.

The operating sleeve is advantageously axially displaceable on the handle, and the handle has at least one longitudinal section where the operating sleeve is freely twistable in both directions. This design makes it possible to disengage the backtwist blocking device by simply displacing the operating sleeve in the axial direction on this longitudinal section, or the backtwist blocking device may be engaged by displacing the operating sleeve toward the upper polygonal longitudinal section of the handle.

For the sake of simplicity, the length area in which the operating sleeve is freely twistable is situated at the lower end of the handle. A self-wringing mop is usually brought into wiping position by pushing down the operating sleeve so that the adjustment of the wiping position as well as the disengagement of the backtwist blocking device may be achieved in one motion in the self-wringing mop according to the present invention.

The manufacturing complexity for a self-wringing mop according to the present invention is reduced by the fact that the handle is divided into exactly two longitudinal sections, namely an upper longitudinal section having a polygonal cross section and a lower longitudinal section where the operating sleeve is freely twistable.

A simple way to achieve the free twistability of the operating sleeve is if the handle has a cross section diameter in the appropriate area that is smaller than the internal diameter of the operating sleeve including blocking elements. In the simplest case, the handle has a round cross section in this area.

A handle having a polygonal upper longitudinal section and a round lower longitudinal section may be manufactured in one piece, in particular if, as is generally the case, it is made of steel, by using a roll molding method where a polygonal cross section is alternatingly formed on the initially round-shaped handle.

The system according to the present invention is applicable in particular to a self-wringing mop in which the cleaning elements include stretched yarns, strings, twine, or the like which are detachably attached with their lower ends to the lower end of the handle and with their upper ends to the lower end of the operating sleeve so that, by displacing the operating sleeve, they may be brought from a lower cleaning position, in which they are sagging loop-like and where the operating sleeve is freely twistable in both directions, into an upper wringing position into the area of the backtwist blocking device in which the cleaning elements may be wrung out by twisting of the operating sleeve. There are no limitations with regard to the cleaning elements to be used.

The handle is preferably made of steel, the operating sleeve is made of plastic, in particular polypropylene (PP), and the blocking elements are also made of plastic, in particular polyoximethylene (POM).

It has been found to be advantageous that the handle has an octagonal cross section in the area of the backtwist blocking device, since, for the usual diameters of a handle of approximately 18 to 24 mm, the octagonal cross section provides adequately sized support surfaces for the blocking element or blocking elements. In addition, the octagonal cross section provides an adequate number of ribbed elevations for this diameter range, so that, even in the case of great restoring forces, twisting in the opposite direction is prevented due to the cooperation with an appropriate number of blocking elements.

It is clear that the number of blocking elements may be freely selected according to the respective application. One blocking element may be sufficient in the case of small restoring forces. However, several blocking elements, at least two, preferably four, are used as a rule.

In a design of a self-wringing mop that is particularly simple to manufacture, the blocking element has the shape of a vertical lamina that is introduceable into a corresponding gap-like receptacle at the upper end of the operating sleeve.

If several lamina-like blocking elements are provided, they are distributed over the circumference of the operating sleeve in an evenly advantageous manner, and are connected to one another at their ends pointing outwardly via an annular element. In this embodiment, the ring including the lamina-like blocking elements may be introduced in a simple manner from above into corresponding gap-like openings of the operating sleeve.

In a preferred embodiment of the present invention, an O-ring made of an elastic material may be used in a simple manner as a restoring spring, which is introduced into an annular circumferential groove at the external circumference of the operating sleeve and of the blocking elements. It is not necessary in a self-wringing mop according to the present invention that the blocking element and the edge-like elevations on the polygonal longitudinal section of the handle enter into a positive connection. This provides a great latitude in design. According to the present invention, the blocking element only needs to have a first pressure surface for the edge-like elevations for outward displacement during twisting in the unblocked direction, as well as a second pressure surface which, during twisting in the opposite direction, deflects the force exerted on the blocking element by the edge-like elevation of the polygonal longitudinal section of the handle to the internal wall of the operating sleeve. In a blocking element that is placed so that it is displaceable tangentially outward, this is achieved in a simple manner due to the fact that the lamina-like blocking element has a recess on its backside, viewed in the twisting direction.

The backtwist blocking device, described above in connection with the self-wringing mop, is not only usable for such, but generally for any system composed of a rod-like element and a twistable sleeve situated on the rod-like element in which twisting in one of the two possible directions is to be prevented. Such a backtwist blocking device includes a rod-like element having ribbed elevations which extend in the axial direction over at least a limited longitudinal section and at least one blocking element radially protruding into the twisting area of the ribbed elevations starting at the sleeve; when the rod-like element is twisted in the blocking direction, the blocking element is pressed against the wall of the sleeve by the ribbed elevations, thus forming a stop for the ribbed elevations; when twisted in the unblocked direction, however, the blocking element outwardly moves past the ribbed elevations against an elastic force. The rod-like element has a polygonal cross section in the limited longitudinal section and the ribbed elevations are formed by the edges of this longitudinal section, which extend in the axial direction.

According to the unblocked direction of the circumferential edges, the blocking element is preferably placed so that it is tangentially displaceable outward.

BRIEF DESCRIPTION OF THE DRAWINGS

In the following, the present invention is explained in greater detail with respect to the drawings, in which.

DETAILED DESCRIPTION

Figure 1:
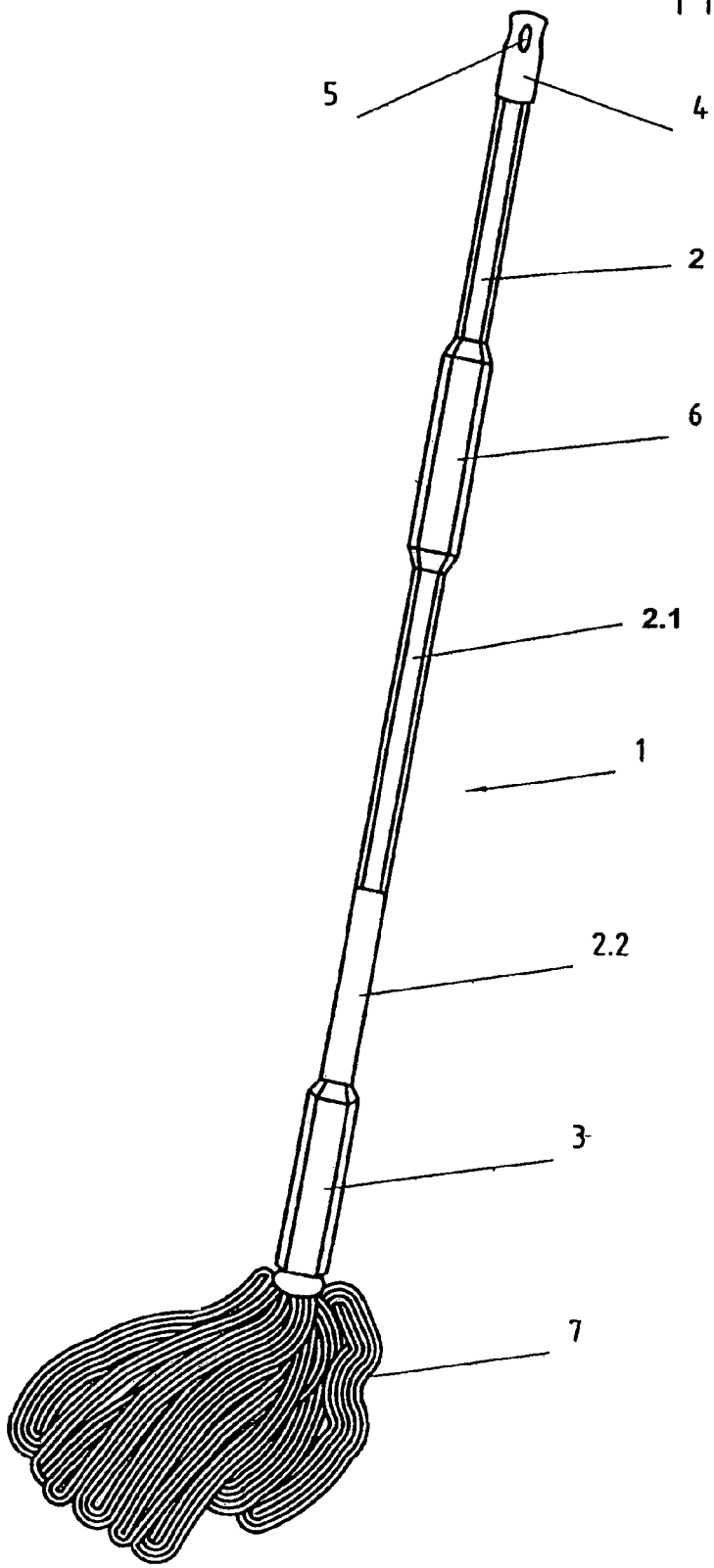
FIG. 1 shows a perspective illustration of the wringing mop according to the present invention.

A self-wringing mop 1 according to the present invention is illustrated in FIG. 1. Self-wringing mop 1 according to the present invention has a handle 2, as well as an operating sleeve that is twistably and axially displaceably mounted on handle 2. An end cap 4 including an eyelet 5 is located at the upper end of handle 2 for hanging mop 1. A grip 6 is situated in the upper area of handle 2 for easier handling of mop 1. In order to prevent the slipping of the hand, the grip is preferably provided with ribs or edges. For this, the grip may also have a polygonal, preferably an octagonal cross section, for example. Mop head 7 is located at the lower end of handle 2. In the illustrated embodiment, the mop head, without restriction of the generality, is composed of string-like elements which are attached with their lower ends to the lower end of handle 2 and with their upper ends are detachably attached to the lower end of operating sleeve 3. Operating sleeve 3 is pushed downward in the illustrated embodiment, so that the string-like elements are sagging downward. Self-wringing mop 1 is in the cleaning position. Furthermore, it is recognizable in FIG. 1 that handle 2 has two different longitudinal sections 2.1, 2.2. According to the present invention, upper longitudinal section 2.1 has a polygonal, preferably an octagonal, cross-section, while lower section 2.2 has a round cross section. In lower section 2.2, operating sleeve 3 is freely twistable in both directions. For wringing out operating sleeve 3 is pushed upward into the area of longitudinal section 2.1 having the polygonal cross section. The operating sleeve is pulled upward for wringing out until the string-like elements are largely stretched and may be wrung out by twisting operating sleeve 3. During wringing out, the blocking element (not shown in FIG. 1) in operating sleeve 3 and the edge-like elevations of upper longitudinal section 2.1 of handle 2 cooperate in such a way that a backtwist due to the restoring force of the stretched string-like elements is prevented. For disengaging the backtwist blocking device, operating sleeve 3 is simply pushed back down into the area of longitudinal section 2.2.

Figure 2:
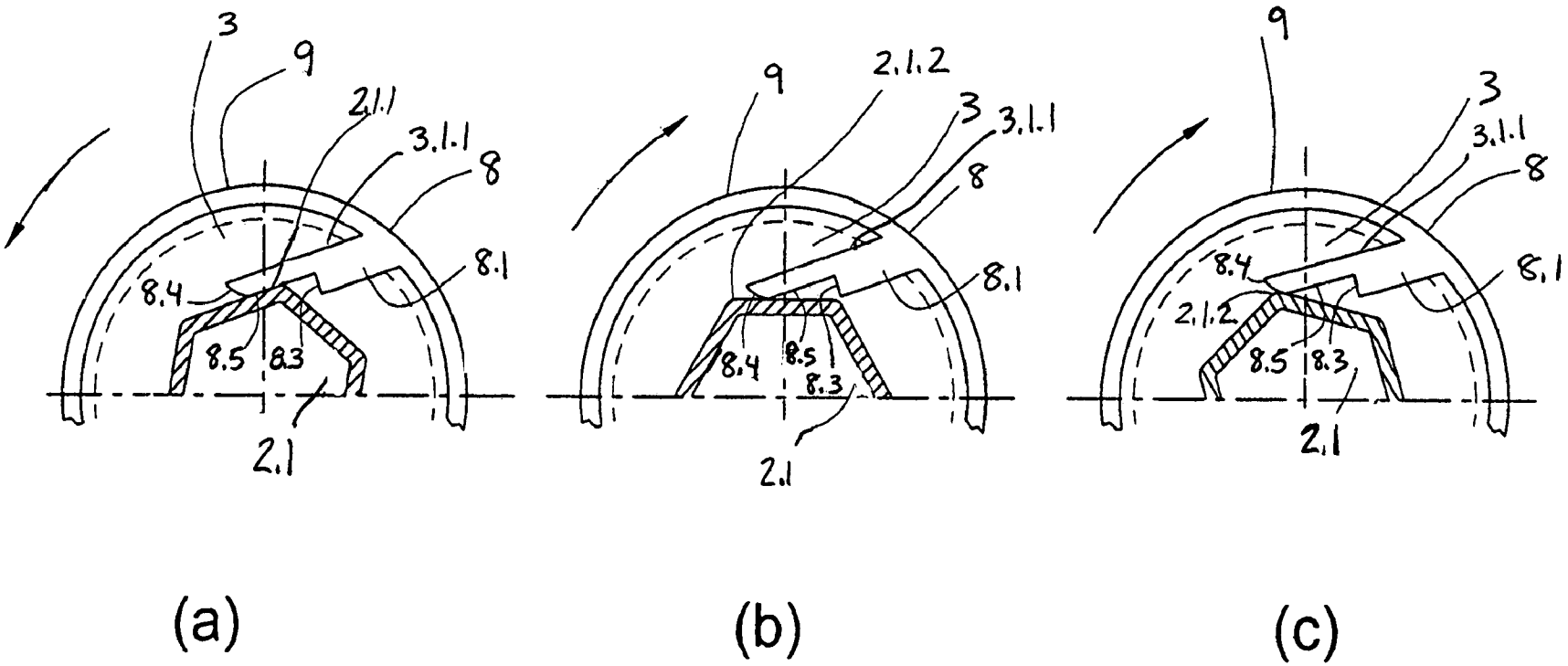
FIGS. 2*a-c* show the function of a backtwist blocking device according to the present invention based upon a schematic cross section illustration of the operating sleeve and the handle in the area of the backtwist blocking device.

FIG. 2 shows the function of the backtwist blocking device according to the present invention. The upper half of the octagonal cross section of upper longitudinal section 2.1 of handle 2 is recognizable in FIG. 2. Furthermore, the upper half of the cross section of operating sleeve 3 as well as blocking element 8 according to the present invention which is situated in a corresponding recess or gap 3.1.1 of the wall of operating sleeve 3 are recognizable. An O-ring, labeled 9, is located in a circumferential annular groove 3.1.2, 8.2 on the external circumference of operating sleeve 3 and blocking element 8. Blocking element 8 is situated in the recess or the gap-like opening 3.1 so that it is tangentially displaceable outward against an elastic force caused by O-ring 9. Blocking element 8 has a recess 8.3 and pressing surfaces 8.4, 8.5. Blocking element 8 protrudes into the internal space of operating sleeve 3. It is recognizable in FIG. 2*a* that the surface of the external circumference of handle 2 adjacent to edge-like elevation 2.1.1 rests on pressing surface 8.5 of blocking element 8 when handle 2 is twisted in the blocking direction. The force, exerted on pressing surface 8.5 when handle 2 is twisted, is deflected from pressing surface 8.5 to the internal wall of operating sleeve 3. The internal wall of operating sleeve 3 supports blocking element 8 and twisting is blocked. FIGS. 2*b* and 2*c* show the function of the backtwist blocking device according to the present invention during twisting in the unblocked direction. During twisting in the unblocked direction, the surface of the external circumference of handle 2 adjacent to edge-like elevation 2.1.2 engages pressing surface 8.4 of blocking element 8. As is recognizable in FIG. 2, blocking element 8 is tangentially displaced outward against the elastic force of O-ring 9. By twisting further, blocking element 8 in the area of the side surface of handle 2 returns to its starting position due to the elastic force of O-ring 9.

Figure 3:
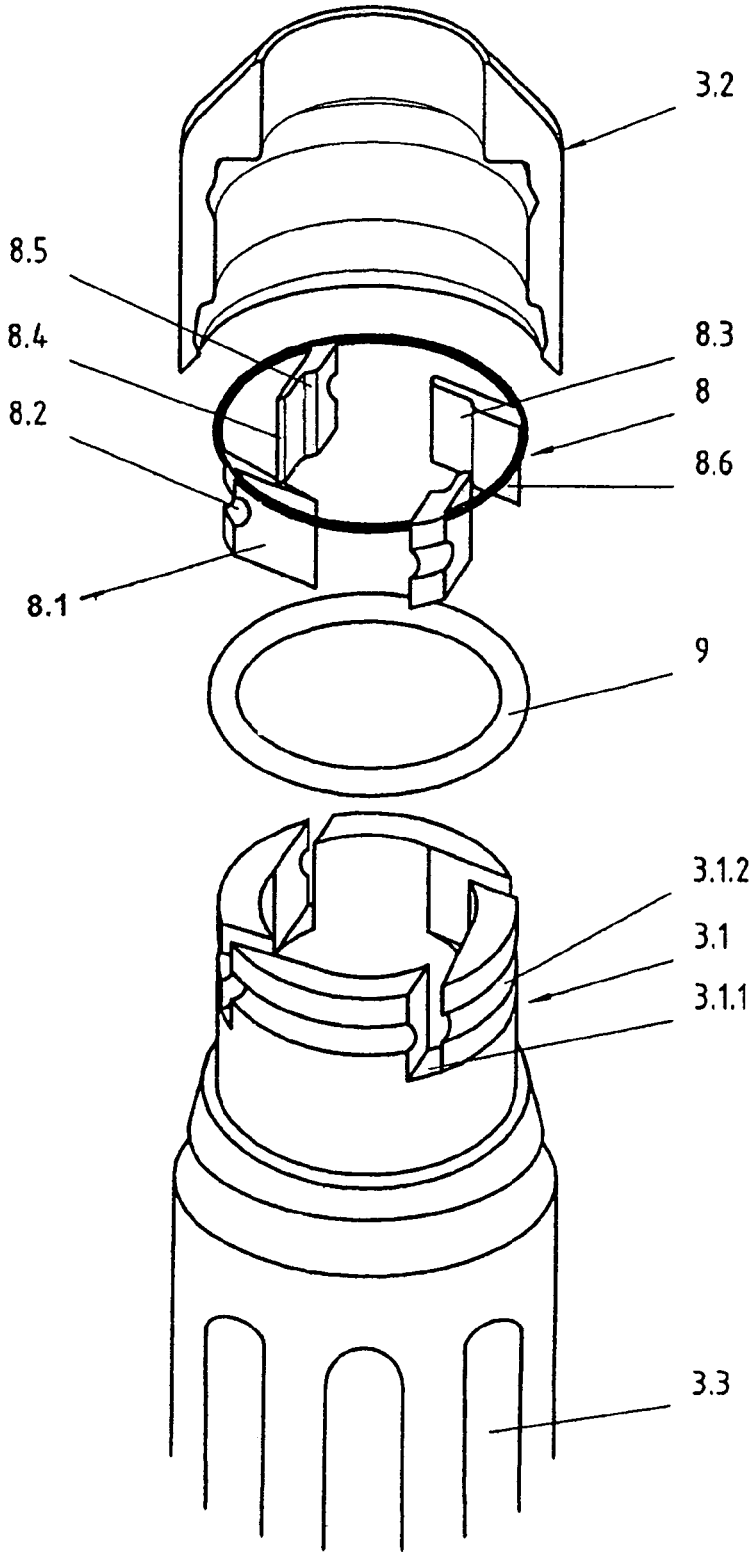
FIG. 3 shows a preferred embodiment of the backtwist blocking device according to the present invention in a schematic perspective illustration.

A preferred embodiment for a blocking element device is illustrated in FIG. 3. It is recognizable in FIG. 3 that operating sleeve 3 has an annular end piece 3.1 at its upper end. Gap-like recesses 3.1.1 are recognizable at the upper end of annular end piece 3.1. Gap-like recesses 3.1.1 are evenly distributed across the circumference of end piece 3.1. Furthermore, an annular circumferential groove for receiving O-ring 9 is recognizable. Blocking elements 8 are attached to an annular holding device 8.6 evenly distributed across its circumference. Blocking elements 8 are placed in such a way that they are insertable into gap-like recess 3.1.1 of annular end piece 3.1. Annular holding device 8.6 has a larger circumference than annular groove 3.1.2, implemented here in an almost rectangular shape and having rounded edges in order to ensure flexibility of blocking elements 8.1 in gap-like recesses 3.1.1. Cap 3.2 protects the blocking element device against damage or adverse effects on its function from the outside. The embodiment illustrated in FIG. 3 has advantages with regard to manufacturing technology. The number of individual parts is limited for example. The risk of losing individual parts is substantially reduced as well. Finally, the illustrated embodiment is characterized by simple assembly.

What is claimed is:

1. A self-wringing mop, comprising:

a handle, the handle including a first longitudinal section having a polygonal cross-section with a plurality of edges running in an axial direction;

an operating sleeve twistably disposed on the handle so as to be twistable relative to the handle in a wringing direction and in an opposite direction;

a mop head disposed at a lower end of the handle and including cleaning elements configured to be wrung out by a twisting in the wringing direction; and at least one blocking element between the handle and the operating sleeve, wherein a twisting of the sleeve in the wringing direction relative to the handle results in the blocking element moving past the plurality of edges against an elastic force, and a twisting of the sleeve in the opposite direction relative to the handle results in at least one of the plurality of edges pressing the blocking element against the operating sleeve so as to block a further twisting in the opposite direction;

the handle including a second longitudinal section having a different cross section from the first longitudinal section, the operating sleeve being axially displaceable from a first position on the first longitudinal section to a second position on the second longitudinal section, wherein the blocking element is disengaged and the operating sleeve is freely twistable relative to the handle when the operating sleeve is in the second position.

2. The self-wringing mop as recited in claim 1, wherein the at least one blocking element is disposed so as to be tangentially displaceable outwardly.

3. The self-wringing mop as recited in claim 1, wherein the second longitudinal section is located at the lower end of the handle.

4. The self-wringing mop as recited in claim 1, wherein the second longitudinal section has a round cross section.

5. The self-wringing mop as recited in claim 1, wherein the handle is integrally formed as a single piece.

6. The self-wringing mop as recited in claim 1 wherein the cleaning elements have lower and upper ends, the cleaning elements being attached at the lower ends to the lower end of the handle and being detachably attached at the upper ends to a lower end of the operating sleeve.

7. The self-wringing mop as recited in claim 6, wherein the cleaning elements include at least one of stretched strings and stretched twine, and wherein the cleaning elements are in a cleaning position when the operating sleeve is in the second position and in a wringing position when the operating sleeve is in the first position.

8. The self-wringing mop as recited in claim 1, wherein the polygonal cross-section is octagonal.

9. The self-wringing mop as recited in claim 1, wherein the at least one blocking element has the shape of a vertical lamina insertable into a corresponding at least one receptacle at an upper end of the operating sleeve.

10. The self-wringing mop as recited in claim 9, wherein the at least one blocking element includes a plurality of lamina-like blocking elements connected to each other at outward ends via an annular element, the plurality of lamina-like blocking elements being evenly distributed across a circumference of the upper end of the operating sleeve.

11. The self-wringing mop as recited in claim 1, wherein the operating sleeve and the at least one blocking element define an annular circumferential groove on an external circumference of the operating sleeve and the at least one blocking element, and further comprising an O-ring made of an elastic material insertable into the circumferential groove.

12. The self-wringing mop as recited in claim 10, wherein the plurality of blocking elements each include a recess on a side facing away from the wringing direction.

13. A self-wringing mop, comprising:

a handle, the handle including a first longitudinal section having a polygonal cross-section with a plurality of edges running in an axial direction;

an operating sleeve twistably disposed on the handle so as to be twistable relative to the handle in a wringing direction and in an opposite direction;

a mop head disposed at a lower end of the handle and including cleaning elements configured to be wrung out by a twisting in the wringing direction;

at least one blocking element between the handle and the operating sleeve, wherein a twisting of the sleeve in the wringing direction relative to the handle results in the blocking element moving past the plurality of edges against an elastic force, and a twisting of the sleeve in the opposite direction relative to the handle results in at least one of the plurality of edges pressing the blocking element against the operating sleeve so as to block a further twisting in the opposite direction; and an O-ring made of elastic material surrounding the at least one blocking element.

14. A self-wringing mop, comprising:

a handle, the handle including a first longitudinal section having a polygonal cross-section with a plurality of edges running in an axial direction;

an operating sleeve twistably disposed on the handle so as to be twistable relative to the handle in a wringing direction and in an opposite direction;

a mop head disposed at a lower end of the handle and including cleaning elements configured to be wrung out by a twisting in the wringing direction; and at least one blocking element between the handle and the operating sleeve, wherein a twisting of the sleeve in the wringing direction relative to the handle results in the blocking element moving past the plurality of edges against an elastic force, and a twisting of the sleeve in the opposite direction relative to the handle results in at least one of the plurality of edges pressing the blocking element against the operating sleeve so as to block a further twisting in the opposite direction;

the at least one blocking element having the shape of a vertical lamina insertable into a corresponding at least one receptacle at an upper end of the operating sleeve;

the at least one blocking element including a plurality of lamina-like blocking elements connected to each other at outward ends via an annular element, the plurality of lamina-like blocking elements being evenly distributed across a circumference of the upper end of the operating sleeve.

15. The self-wringing mop as recited in claim 14 wherein the plurality of blocking elements each include a recess on a side facing away from the wringing direction.

16. A self-wringing mop, comprising:

a handle, the handle including a first longitudinal section having a polygonal cross-section with a plurality of edges running in an axial direction;

an operating sleeve twistably disposed on the handle so as to be twistable relative to the handle in a wringing direction and in an opposite direction;

a mop head disposed at a lower end of the handle and including cleaning elements configured to be wrung out by a twisting in the wringing direction;

at least one blocking element between the handle and the operating sleeve, wherein a twisting of the sleeve in the wringing direction relative to the handle results in the blocking element moving past the plurality of edges against an elastic force, and a twisting of the sleeve in the opposite direction relative to the handle results in at least one of the plurality of edges pressing the blocking element against the operating sleeve so as to block a further twisting in the opposite direction; and a cap protecting the blocking element.

* * * * *